United States Patent [19]

Hofer

[11] Patent Number: 4,498,188

[45] Date of Patent: Feb. 5, 1985

[54] ELECTRONIC STETHOSCOPE FOR MONITORING THE OPERATION OF A PROSTHETIC VALVE IMPLANTED IN A PATIENT'S HEART

[75] Inventor: Alan Hofer, Wantagh, N.Y.

[73] Assignee: Stanton Magnetics, Inc., Plainview, N.Y.

[21] Appl. No.: 491,547

[22] Filed: May 4, 1983

[51] Int. Cl.[3] ..... H04R 1/46

[52] U.S. Cl. ..... 381/67; 181/131; 128/715

[58] Field of Search ..... 179/107 R; 381/67; 181/131; 128/715

[56] References Cited

U.S. PATENT DOCUMENTS 3,233,041 2/1966 Croslin ..... 381/67

3,555,187 1/1971 Rowley ..... 381/67

*Primary Examiner*—Gene Z. Rubinson

*Assistant Examiner*—Danita R. Byrd

*Attorney, Agent, or Firm*—Kane, Dalsimer, Kane, Sullivan & Kurucz

[57] ABSTRACT

An electronic stethoscope for monitoring prosthetic valves for hearts includes a casing to which the center portion of a spring member is mounted. A weighted housing is mounted to the ends of the spring member and contains an opening therethrough in which a magnetic circuit comprising a pole piece, magnet and coil are positioned. The air gap between the pole piece and magnet is varied as the relative distance between the center of the spring and housing vary in response to the operation of a prosthetic heart valve thereby resulting in an induced voltage in the coil which may be amplified and monitored.

4 Claims, 3 Drawing Figures

ELECTRONIC STETHOSCOPE FOR MONITORING THE OPERATION OF A PROSTHETIC VALVE IMPLANTED IN A PATIENT'S HEART

BACKGROUND OF THE INVENTION

Approximately 80,000 prosthetic heart valves are implanted each year. Such valves function by means of an occluding disc moving within a cage opening and closing a passage at a frequency of approximately 1,500 Hz. The cage is commonly formed of metal and hence the movement of the occluding disc produces a distinctive click sound which often is audible through the chest wall.

In some implantations either the cage, disc or both may deteriorate which can lead to the eventual failure of the valve. This may result from a separation of the cage struts or the disc becoming misshaped.

Since a properly operating valve produces a definite and distinctive sound pattern the condition and operation of the heart valve are subject to being acoustically monitored. Although this appears relatively easy to accomplish, in fact, it is most difficulty to do for several reasons. As noted above, prosthetic heart valves operate at frequencies on the order of approximately 1,500 Hz. Accordingly, conventional stethoscopes cannot be used to monitor the valve operation since their operating range is limited to frequencies below approximately 150 Hz as a result of the rubber tubes which connect the transducers to the ear piece. The tubes serve to dim out sounds at frequencies higher than approximately 150 Hz. A conventional microphone-type pickup placed against a patient's chest might pick up the valve sound but it would also pick up extraneous sounds such as the sound of blood rushing through the patient's circulatory system, breathing and in addition to lung noises, etc. the sounds associated with the prosthetic valve operation and thus the fine differences in the valve operation sought to be detected would be lost without extensive and elaborate filtering.

In view of the above, it is the principal object of the present invention to provide an improved stethoscope specifically adapted to pick up the sound of a prosthetic heart valve while automatically filtering out all other sounds;

a further object is to provide such a device which may be packaged in a housing convenient for application to a patient's chest;

a still further object is to provide such a device which may readily be tuned to a particularly prosthetic valve so that any change in the valve condition will quickly be detected;

still further objects will be apparent from the following description of the invention.

SUMMARY OF THE INVENTION

The above and other beneficial objects and advantages are attained in accordance with the present invention by providing a stethoscope of the electronic type comprising a transducer, amplifier and speaker. The transducer includes a casing to which the center portion of a generally "S"-shaped spring member of magnetic material is mounted. The ends of the spring are connected to a weighted housing. The housing includes a central opening containing a magnetic circuit consisting of a ring magnet, pole piece, and coil. Variations in the air gap between the magnet and pole piece induce a voltage change in the coil which is amplified and fed to the speaker. The air gap is varied by virtue of the central portion of the spring moving toward and away from the center of the housing in response to the movement of the valve. The spring member has a stiffness and an overall length which cooperates with the mass of the housing to produce a mechanical circuit designed to resonate at the fundamental or a harmonic of the frequency of the valve to be monitored.

DETAILED DESCRIPTION OF THE PREFERRED EMBODIMENT

Figure 1:
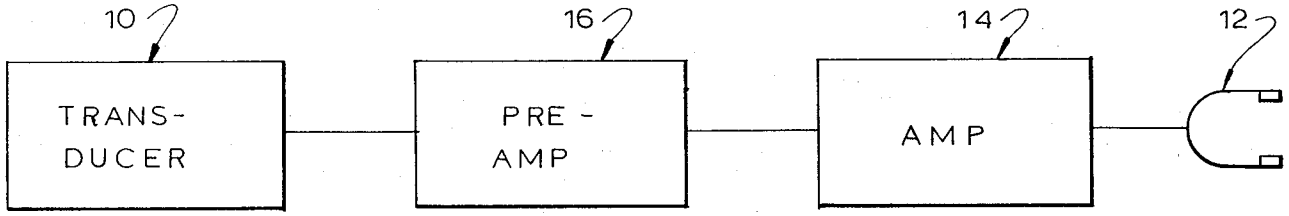
FIG. 1 is a simplified block diagram of the electronic stethoscope in accordance with the present invention.
Figure 2:
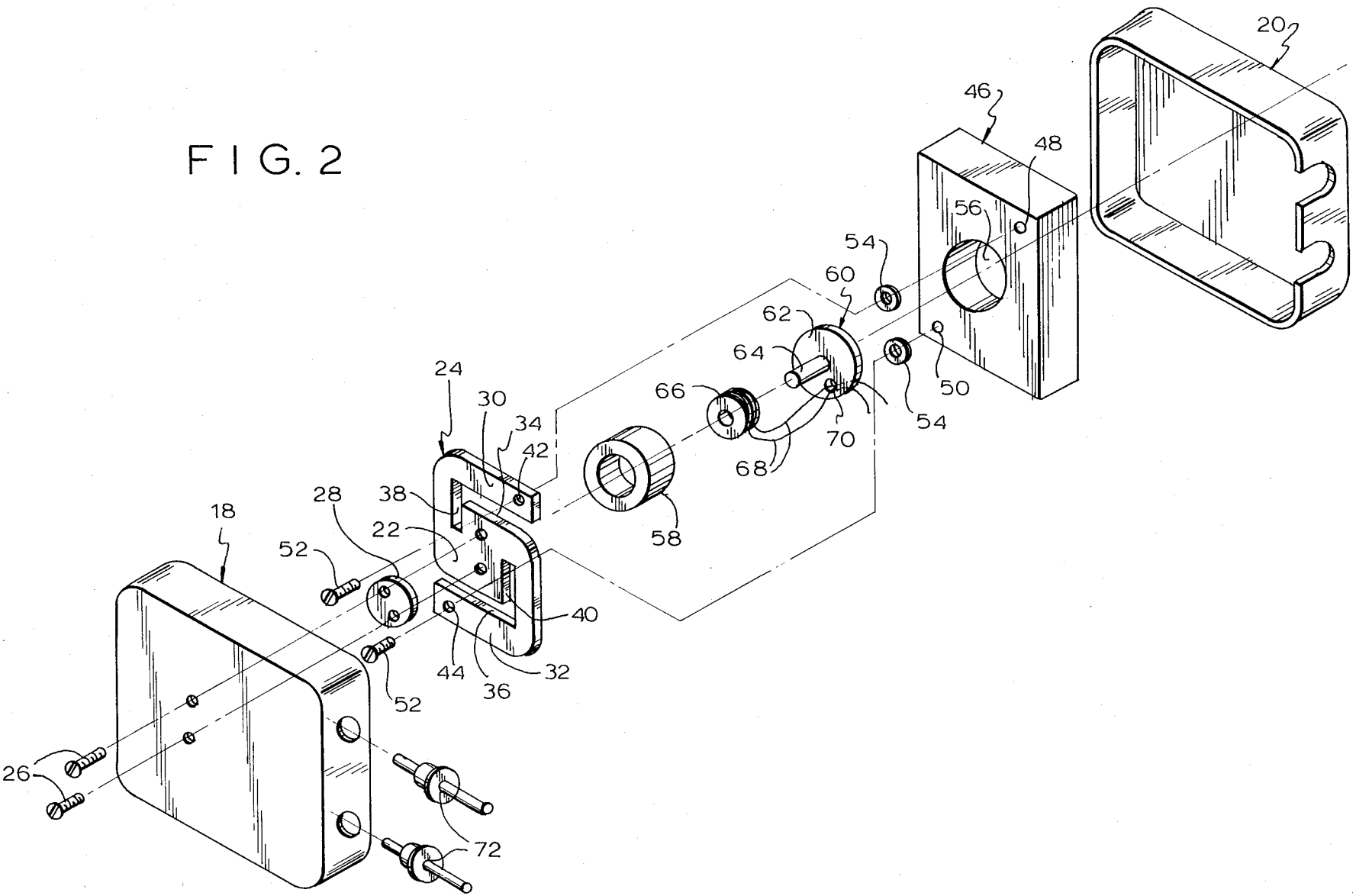
FIG. 2 is an exploded representation of the transducer of an electronic stethoscope in accordance with the present invention; and, FIG. 3 is a fragmentary sectional view of the electronic stethoscope transducer when assembled with component sizes exaggerated for clarity.

Reference is now made to the drawings and to FIG. 1 in particular wherein an electronic stethoscope in accordance with the present invention is shown comprising a pickup transducer 10 the output of which is connected to a headset 12 through an amplifier 14 and preamplifier 16. As shown in FIG. 2, the transducer comprises a casing formed of two halves 18 and 20. The center 22 of a generally "S"-shaped spring member 24 is secured to the interior of the top of the upper casing member 18 by a pair of screws 26 and held spaced from the casing interior surface by a spacer 28. Spring member 24 is formed of a magnetically permeable material and includes oppositely directed arms 30 and 32. Each of the arms 30, 32 is separated from the center portion 22 of the spring, by a separating slot 34, 36 which extends parallel to its associated arm and which terminates in a transverse section 38, 40 which extends perpendicular to the associated arm 30, 32. As a result, spring 24 defines the equivalent of an elongated member the overall length of which is defined by the length of the arm-defining slots 34, 36 as well as the length of their associated tuning slots 38, 40. A mounting hole 42, 44 is provided near the free end of each of arms 30 and 32 respectively.

The transducer 10 further includes a housing 46 which comprises a relatively heavy, non-magnetic member formed of a material such as brass of the like. Housing 46 is dimensioned to fit within the assembled casing and includes threaded openings 48 and 50 in registry with the openings 42 and 44 of the arms of spring member 24. The housing 46 is secured to the arms spring member 24 via a pair of screws 52 and held apart from the spring by gap spaces 54 interposed between the spring and housing.

Housing 46 is provided with a central opening 56 into which a magnetic circuit is positioned. The magnetic circuit comprises a hollow ring magent 58 which fits closely within housing opening 56. A pole piece 60 formed of a permeable material which includes a base portion 62 which is soldered to the bottom of the magnet and a stem 64. The height of the stem 64 is the same as that of the ring magnet 18. A coil 66 fits about the stem portion 64 of pole piece 60 and is secured in position. The leads 68 of coil 66 extend through an opening 70 in the base 62 of the pole piece 60 to engage a pair of terminal pins 72 that extend through suitable openings through the casing to engage leads to the preamplifier.

Figure 3:
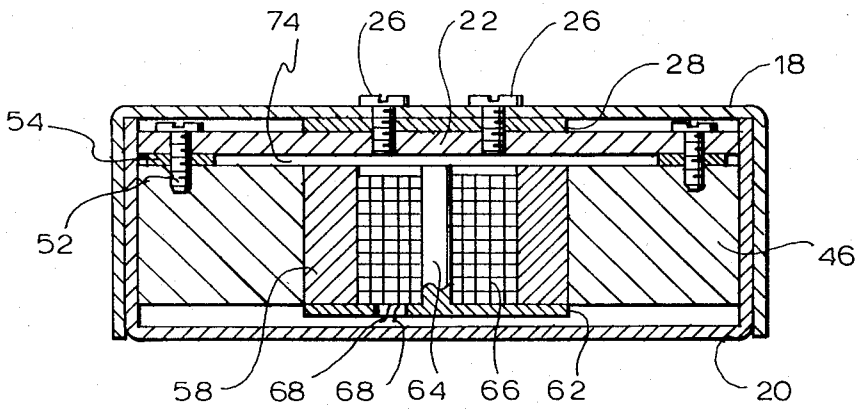

Referring to FIG. 3, it can be seen that in the assembled housing the pole piece stem 64 and the top of ring magnet 58 lie in a common plane with the top of the housing and cooperate in defining an air gap 74 which varies as the housing 44 moves toward and away from the center portion 22 of spring 24 which, in turn is fixed to the casing.

In operation the transducer unit 10 is placed on a patient's chest close to his heart. The transducer casing will move in response to the sound of the valve disc moving within the valve cage. However, due to its inertia, the housing 46 will resist such movement thereby causing the center portion 22 of the spring 24 to move toward and away from the magnetic circuit nested in the housing opening so as to vary the air gap between the pole piece stem and magnet to thereby vary the magnetic flux induced in the coil. The variation in flux results in a voltage which may be preamplified and then amplified as an audible tone. Once the tone of a properly acting prosthetic heart valve is known, any change in the operation of the heart valve may readily be detected by a corresponding change in the tone of the detected signal.

An important feature of the present invention is the "S"-shaped spring element. Since each prosthetic heart valve operates at its own frequency, the length of the tuning slots provides a convenient means for tuning the transducer so that the resonant frequency of the mechanical circuit comprising the spring and housing corresponds to a fundamental or simple harmonic of the valve.

It should be appreciated that the transducer described above will resonate at or near the desired frequency determined by that of the properly operating prosthetic valve. Any sounds other than those produced by the valve are assumed to be at other frequencies and hence will automatically be filtered out and not detected. Thus, any change in the output of the valve may be attributed to a malfunction in the prosthetic valve.

Thus, in accordance with the above, the aforementioned objects and advantages are effectively attained.

Having thus described the invention, what is claimed is:

1. A stethoscope for monitoring a prosthetic valve for a heart, said stethoscope including a transducer comprising:

a casing;

a generally S-shaped spring member of magnetic material having a center portion mounted to an interior surface of said casing and a pair of free arm portions;

a weighted housing mounted to said spring member free arm portions;

a magnetic circuit mounted to said housing and adapted to move therewith, said circuit including an air gap and a coil whereby changes in said air gap induce a voltage change in an output voltage induced in said coil;

said spring including a portion disposed with respect to said housing for varying said air gap in response to movement of said housing with respect to said spring, said spring having a length and stiffness cooperating with the mass of said housing to produce a mechanical circuit having a resonant frequency substantially equal to the operating frequency of the valve to be monitored.

2. The stethoscope in accordance with claim 1 wherein each of said arm portions is separated from said center portion by a slot extending generally parallel to said arm and further comprising a tuning slot extend generally transverse to said separating slot.

3. The invention in accordance with claim 1 wherein said housing includes a central opening generally aligned with said spring center portion and said magnetic circuit is mounted in said housing center opening.

4. The invention in accordance with claim 3 wherein said magnetic circuit comprises: a ring magnet disposed within said housing center opening; a pole piece having a stem portion coaxial with the ring magnet and extending therethrough; and the tops of said pole piece stem and ring magnet are coplaner with a surface of said housing directed toward said spring.

* * * * *